US005709351A

United States Patent [19]

Osborn et al.

[11] Patent Number: 5,709,351

[45] Date of Patent: Jan. 20, 1998

[54] WIRE ROLLER

[76] Inventors: Melvin Osborn; Esther Osborn, both of 4032 Osborn Loop, American Falls, Id. 83211

[21] Appl. No.: 587,139

[22] Filed: Jan. 16, 1996

[51] Int. Cl.[6] ..... B65H 75/42

[52] U.S. Cl. ..... 242/391.3

[58] Field of Search ..... 242/391, 391.1, 242/391.2, 391.3

[56] References Cited

U.S. PATENT DOCUMENTS

| | | | |
|---|---|---|---|
| 232,136 | 9/1880 | Leonard | 242/391.1 |
| 277,030 | 5/1883 | Haworth | 242/391.2 |
| 305,597 | 9/1884 | James | 242/391.2 |
| 368,648 | 2/1887 | Nelson | 242/391.3 |
| 677,487 | 7/1901 | Winget | 242/391.1 |
| 915,311 | 3/1909 | Sessions | 242/391.3 |
| 1,501,800 | 7/1924 | Novotne | 242/391.3 |
| 2,563,377 | 8/1951 | Schmidt | 242/391.1 |
| 4,339,096 | 7/1982 | May . | |
| 4,473,196 | 9/1984 | Sammann et al. . | |
| 5,054,745 | 10/1991 | Swayze et al. . | |
| 5,158,243 | 10/1992 | Sigle et al. . | |
| 5,163,634 | 11/1992 | Moon et al. . | |
| 5,246,182 | 9/1993 | Lester . | |

*Primary Examiner*—John M. Jillions
*Attorney, Agent, or Firm*—Frank J. Dykas

[57] ABSTRACT

A friction driven wire roller for attachment to a farm utility vehicle. The apparatus includes the drum attached to a frame, the drum being in contact with a wheel of the vehicle. As the drum rotates, it's motion is transmitted to a spool of wire, and wire is either fed out or taken in. The apparatus can be attached to any vehicle and is powered by contact with a wheel of that vehicle.

10 Claims, 4 Drawing Sheets

WIRE ROLLER

BACKGROUND OF THE INVENTION

1. Technical Field

This invention generally relates to devices for letting out or taking up wire from spools. More particularly, this invention relates to a wire roller which is powered by the movement of the wheel of a vehicle.

2. Background

Farm and ranch operations involve many activities which require either the laying out or taking up of flexible material such as wire, rope, tape, cable. Some of these operations involve laying out wire for a fence, taking up wire from a fence that is being dismantled, laying out wire for phone lines, laying out wire for the electronic controls of irrigation systems, laying out or taking up rope or colored plastic marking tape, and other jobs involving spools of flexible material. These jobs can be facilitated by the use of vehicles of various sorts. Tractors are commonly used and can come in various sizes. There are implements which attach to tractors which are specifically designed to lay out or take up wire or other flexible materials. Another vehicle which can be used for these farm or ranch operations are small three or four wheel utility vehicles, also known as all terrain vehicles. These vehicles provide the maneuverability of a motorcycle with the stability of a 4-wheeled vehicle. Farm operations use them for many tasks, such as providing transportation to remote areas of the site, carrying tools and hauling materials for jobs.

When done by hand, the job of laying out or retrieving fencing wire is very cumbersome and dangerous. Typically, a spool of wire is carried by two men with a rod through its axle and as they walk, the wire is rolled out onto the ground. To pick up the wire, two men walk backwards and rotate the empty spool of wire to pick up the wire. The same technique is used for control wire, rope, tape, cable, and other flexible material. Various powered mechanisms also exist for laying out and picking up wire, using a tractor power take-off (PTO) or using the three point hitch, possibly combined with a hydraulic motor. These systems require the use of a tractor with a PTO and three point hitch, sometimes a hydraulic motor, and require that the wire take-up or laying down operation be conducted behind the driver.

Rolls of flexible material, whether they are barbed wire, telephone wire, electric fence wire or any type of fencing wire, rope, cable, or tape, are very heavy and difficult for one man to handle.

The present invention addresses this problem by providing a simple device which can attach to a vehicle and, driven by the vehicle's wheel, can either take up or lay down any kind of flexible material on a spool. This enables one man to do the work of two, and it enables that person to use any vehicle from a small personal vehicle, to a larger tractor.

3. Background Art

Sammann, U.S. Pat. No. 4,473,196, teaches a hydraulically actuated wire roller for a tractor. This wire roller is driven by a hydraulic motor and attaches to the 3-point hitch of a farm tractor.

Lester, U.S. Pat. No. 5,246,182, teaches a wire winding attachment for tractors which is driven by the power take-off of a tractor. The wire is wound on to a spool from the side of a tractor, rather than from directly behind or in front of the tractor.

May, U.S. Pat. No. 4,339,096, teaches a cable-laying apparatus to be attached to farm tractors with a rear three-point hydraulically operated hitch. The wire spool freely rotates and lays out cable behind the tractor. Since the wire spool is not powered, it does not take up wire.

Sigle, U.S. Pat. No. 5,158,243, teaches a method for dispensing wire which consists of a hitch attachment and a wire spool supported by two wheels. The wire spool is not powered, so it functions only to play out wire as the tractor is driven away from the point of attachment.

Moon, U.S. Pat. No. 5,163,634, teaches an apparatus for laying out and stretching fence. The apparatus is attached to the three-point hitch of a tractor. This invention is powered by a hydraulic motor.

Swayze, U.S. Pat. No. 5,054,745, teaches an auxiliary winch for an all-terrain vehicle (ATV). The winch consists of a cable spool attached to the axle of the ATV. When the axle of the ATV turns, cable is wound onto the spool, and if the other end of the cable is attached to a fixed object, causes the ATV to pull itself out of sand or mud where it may be trapped. The wire spool is directly attached to the ATV's axle and when not being used as a winch, is used as storage for the cable wire.

Each of these prior inventions shows an approach to the task of laying out or taking up wire. However, none of them allows a single person to lay or take up wire or other flexible material using a vehicle, and using a system which is easily attachable and does not require the use of a three-point hitch, or a hydraulic motor. Accordingly, one of the objects of the present invention is to provide a device which satisfies this need.

DISCLOSURE OF INVENTION

This object, along with others, is accomplished by a wire spool whose rotation is powered by the rotation of the wheel of a vehicle. The rotation of the wheel of a vehicle is used to cause the rotation of a wheel or drum attached to a frame which is mounted to the vehicle. The wire spool is mounted on a frame which itself mounts on the luggage rack or any appropriate attachment point on the body or fender of any vehicle. The powered wire roller, attached to a vehicle, can be used to lay out or take up wire. The wire roller can be attached to the front or rear of an all terrain vehicle with a luggage rack or other suitable point of attachment on any vehicle.

BEST MODE FOR CARRYING OUT INVENTION

Figure 1:
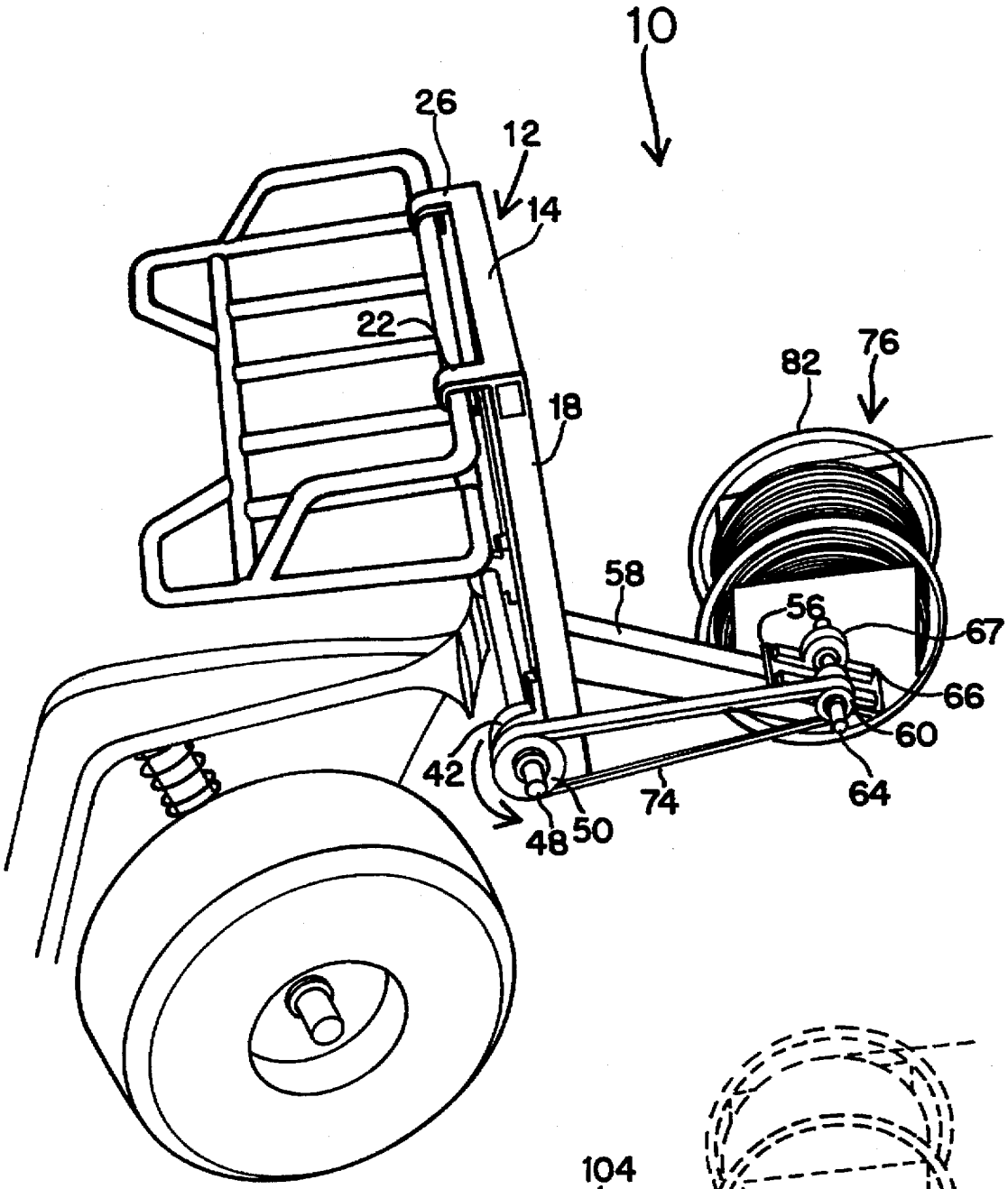
FIG. 1 is a perspective view of the wire roller looking at the roller from the side and from above.
Figure 1A:
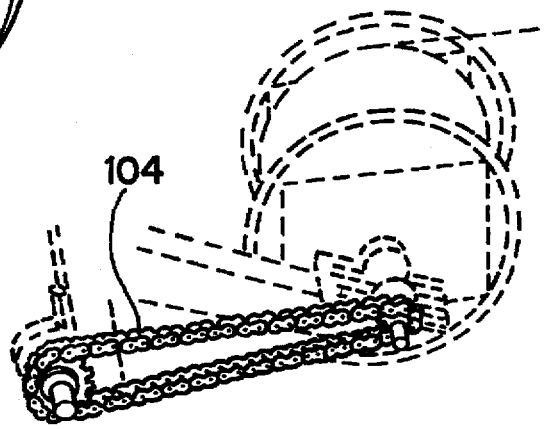
FIG.1A is a perspective view of a version of the wire roller which is driven by a chain.
Figure 2:
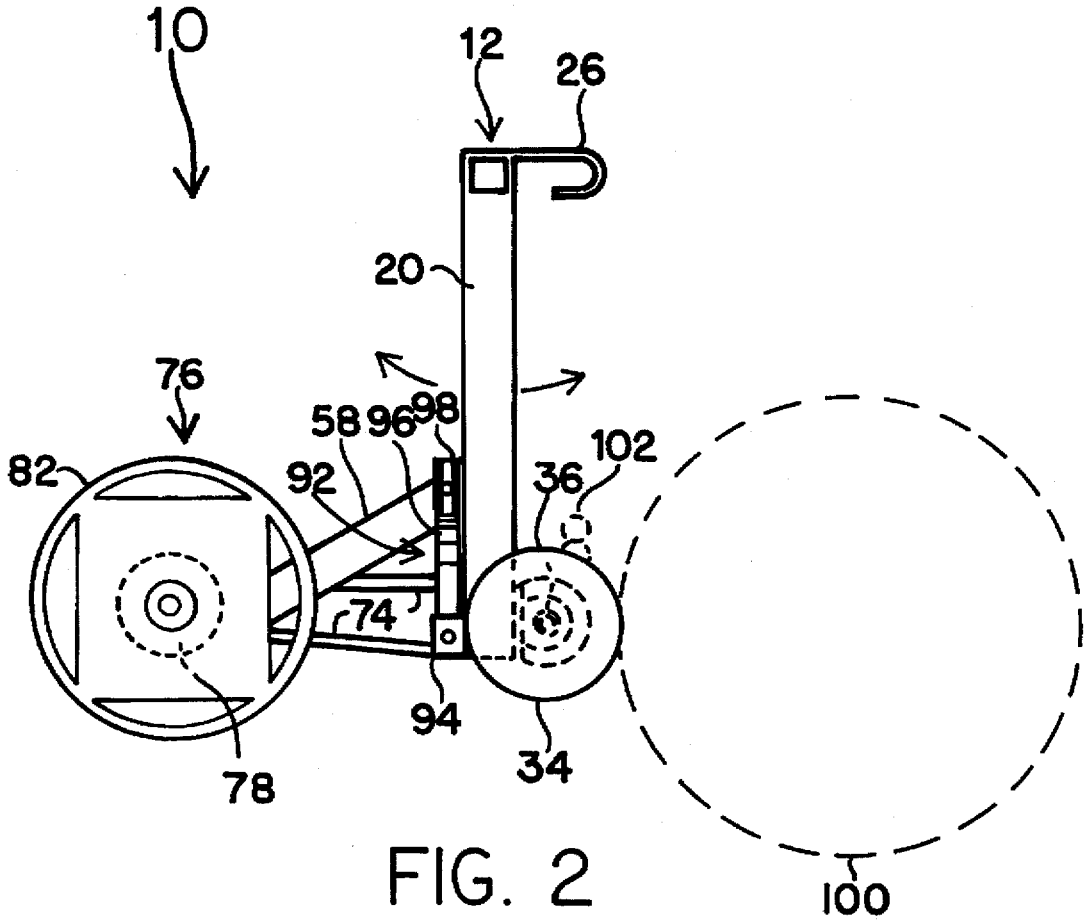
FIG. 2 is a side view of the wire roller showing the power drum in contact with the wheel of the ATV.
Figure 3:
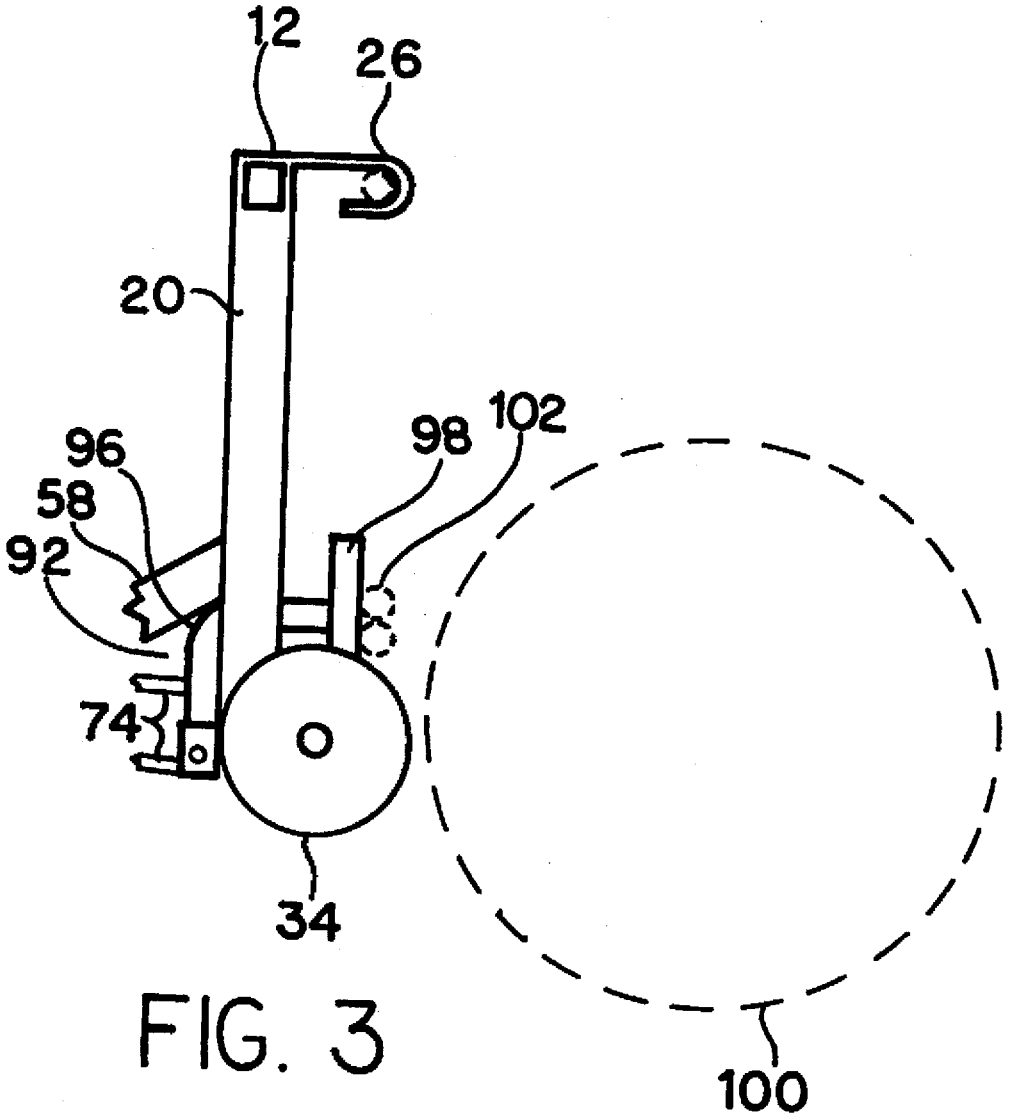
FIG. 3 is a side view of the wire roller showing the power drum disengaged from the wheel of the ATV.
Figure 4:
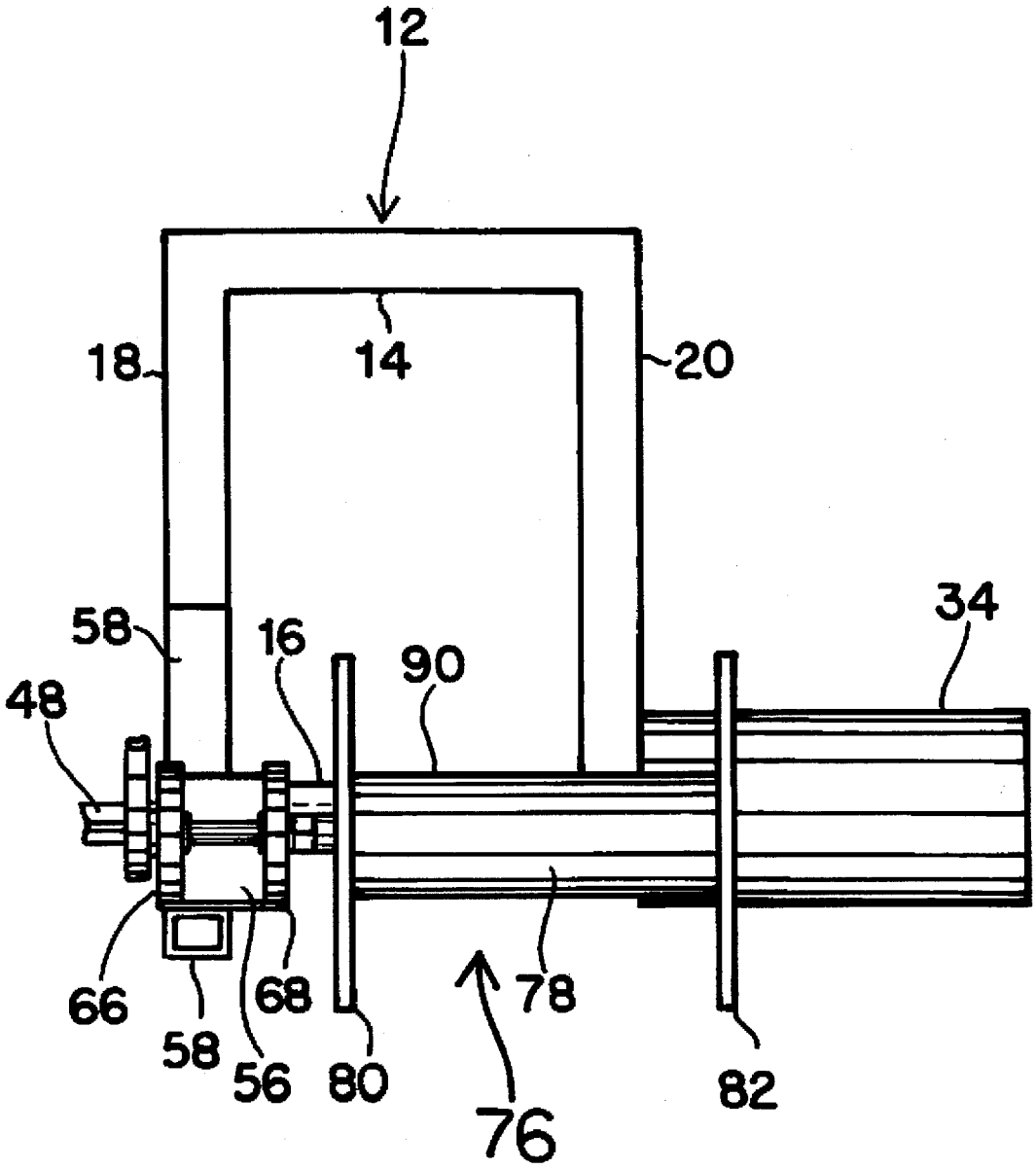
FIG. 4 is a front view of the wire roller showing the frame, a wire spool and the power drum.

In FIG. 1 of the drawings, together with FIGS. 2 through 4 thereof, there is disclosed a wire roller apparatus made in accordance with the present invention. The apparatus is removably attached to a vehicle, such as, for example, a Honda Fourtrax, 4-wheel utility vehicle or other vehicle. The apparatus consists of a frame 12 which is composed of two vertical members 18 and 20 and two horizontal members 14 and 16. These four members are joined at their corners to form a rectangular shape. The upper horizontal member 14 is attached to mounting brackets 22 and 26. Attached to the frame is power drum 34, which attaches to the frame by bearing bracket 36 and bearing bracket 42. Through these two bearing brackets, drive shaft 48 passes, and connects to power drum 34. At the end of drive shaft 48, drive pulley sheave 50 attaches. From frame 12 extension arm 58 extends. At the end of extension arm 58, spool mounting plate 56 is attached to extension arm 58. Attached to spool mounting plate 56 are the left spool axle bearing bracket 66 and the right spool axle bearing bracket 68. Through the axle spool brackets 66 and 68, the spool axle 64 passes. At the end of the spool axle is attached the spool pulley sheave 60. Spool pulley sheave 60 is linked to the drive pulley 50 sheave by drive belt 74. At the other end of the spool axle is attached wire spool 76. Wire spool 76 is composed of a spool core 78, left side of spool end 80, and right side of spool end 82. The spool core 78 has a slot called the wire slot 90 into which wire is fed to begin wire take-up. Attached to frame 12 is engagement pin bracket 94. Into this engagement pin bracket, engagement pin 92 is inserted. Engagement pin 92 consists of engagement pin arm 96 and engagement pin head 98.

In operation, mounting brackets 22 and 26 attach the wire roller to a tractor, such as a Honda 4-wheel utility vehicle. When engagement pin 92 is rotated away from the tractor frame or bumper, power drum 34 is allowed to come in contact with the left front wheel of the tractor. As the tractor moves forward, its front wheel begins to turn, and power drum 34 turns in the opposite direction. As power drum 34 turns, drive shaft 48 also turns, which rotates drive pulley sheave 50. Drive pulley sheave 50 turns drive belt 74, which in turn causes spool pulley sheave 60 to rotate. As spool pulley sheave 60 rotates, spool axle 64 also rotates and this causes the wire spool 78 to rotate in a direction opposite to the rotation of the tractors wheels. If the wire roller is attached to the front of a tractor and the tractor moves forward, the wire spool can roll up wire onto the empty spool. If the intent is to lay out wire rather than take up wire, the wire roller can be mounted to the back of the tractor by a luggage rack or other point of attachment. One end of the wire would then be attached to a fence post and the tractor would drive away. As the tractor drove away, wire from the spool would unroll, but since it is being fed by the drive system would not fall freely off the spinning reel which would cause tangling of the wire. When taking up wire onto the roll, the wire spool is directly in the driver's line of vision and he can cause the tractor to move back and forth slightly to facilitate even winding of the wire onto the spool.

The present invention provides a very practical way to build a wire fence or perform other jobs using flexible material, using a simple and inexpensive wire rolling mechanism. A variety of vehicles can be used from four wheel ATV's to tractors or automobiles. The wire roller can be used to lay out wire, or to take in wire, whichever is needed. Any kind of flexible material can be handled, such as barbed wire, electric fence wire, telephone wire, fence wire, electrical wire, rope, twine, cable, hosing, tubing, and tape.

While there is shown and described the present preferred embodiment of the invention, it is to be distinctly understood that this invention is not limited thereto but may be variously embodied to practice within the scope of the following claims.

I claim:

1. A mechanism mounted on a vehicle with a wheel for taking up or feeding out flexible material, comprising:

a frame hingedly mountable, at one end thereof on the vehicle;

an extension arm mounted to the frame and extending out therefrom, the outer end of the extension arm located at the other end of the frame;

a spool rotatably attached to the outer end of the extension arm, for holding flexible material;

a cylindrical drum mounted to the frame at the other end thereof and which is held in contact by gravity with the entire surface of the vehicle wheel and is turned by friction with said vehicle wheel and is connected to the spool by means of a belt.

2. The mechanism of claim 1, wherein the means of converting motion of the vehicle to the spool is a drum which contacts a wheel of the vehicle and is turned by friction, and is connected to the spool by means of a belt.

3. The mechanism of claim 1, wherein the means of converting motion of the vehicle to the spool is a drum which contacts a wheel of the vehicle and is turned by friction, and is connected to the spool by means of a chain.

4. The mechanism of claim 1, wherein the means of converting motion of the vehicle to the spool is a drum which contacts a wheel of the vehicle and is turned by friction, and is connected to the spool by means of a drive shaft.

5. The mechanism of claim 1, wherein the means of converting motion of the vehicle to the spool is a wheel which contacts a wheel of the vehicle and is turned by friction, and is connected to the spool by a belt.

6. The mechanism of claim 1, wherein the means of converting motion of the vehicle to the spool is a wheel which contacts a wheel of the vehicle and is turned by friction, and is connected to the spool by a chain.

7. The mechanism of claim 1, wherein the means of converting motion of the vehicle to the spool is a wheel which contacts a wheel of the vehicle and is turned by friction, and is connected to the spool by means of a drive shaft.

8. The mechanism of claim 1, which has a means for disengaging the mechanism from the vehicle wheel.

9. The mechanism of claim 8, wherein the means for disengaging the mechanism from the wheel of the vehicle is a device which lifts the mechanism away from the wheel.

10. The mechanism of claim 9, wherein the device which lifts the mechanism away from the wheel is a rotatable arm.

* * * * *